United States Patent [19]

Yin

[11] Patent Number: 4,933,518

[45] Date of Patent: Jun. 12, 1990

[54] VACUUM INTERRUPTER

[75] Inventor: Simon Yin, Fremont, Calif.

[73] Assignee: Square D Company, Palatine, Ill.

[21] Appl. No.: 252,682

[22] Filed: Oct. 3, 1988

[51] Int. Cl.[5] ..... H01H 33/66
[52] U.S. Cl. ..... 200/144 B
[58] Field of Search ..... 200/144 B

[56] References Cited

U.S. PATENT DOCUMENTS

| | | | |
|---|---|---|---|
| 4,234,771 | 11/1980 | Ohkawa et al. | 200/144 B |
| 4,394,554 | 7/1983 | Warabi et al. | 200/144 B |
| 4,440,995 | 4/1984 | Lange et al. | 200/144 B |
| 4,665,287 | 5/1987 | Sofianek et al. | 200/144 B |

FOREIGN PATENT DOCUMENTS

| | | | |
|---|---|---|---|
| 2094064 | 9/1982 | United Kingdom | 200/144 B |

*Primary Examiner*—Robert S. Macon
*Attorney, Agent, or Firm*—Flehr, Hohbach, Test, Albritton & Herbert

[57] ABSTRACT

Vacuum interrupters having improved structural rigidity and internal vacuum integrity are provided for use in vacuum circuit breakers. Due to the design and construction of the endcap assemblies, the vacuum interrupters require a reduced total length of brazed seams, and the incidence of vacuum loss due to faulty seams is thereby reduced. An improved stationary terminal assembly including a reinforcing member providing increased structural rigidity is also provided.

15 Claims, 3 Drawing Sheets

VACUUM INTERRUPTER

TECHNICAL FIELD

The present invention relates generally to vacuum interrupters for use in vacuum circuit breakers and the like and relates, more specifically, to vacuum interrupters having an improved stationary terminal assembly providing enhanced internal vacuum integrity and increased structural rigidity.

BACKGROUND ART

Interruption in a vacuum circuit breaker is achieved by vacuum interrupters which require only a short contact gap for circuit interruption. Vacuum interrupters typically comprise an insulating cylindrical envelope composed, for example, of glass or alumina, with endcaps mounted at each end to form a closed cylinder. Stationary and movable current conducting terminals are mounted through the endcaps at opposite ends of the cylindrical envelope. The movable terminal is moved axially to make or break contact between the movable and stationary contacts, thereby making or breaking the electrical circuit.

Vacuum interrupters of this type are required to maintain an internal vacuum on the order of about $10^{-7}$ Torr to interrupt the current flowing in the electrical circuit. Loss of vacuum permits air or other molecules to enter the evacuated volume, which reduces the internal vacuum and thereby reduces the interrupting capacity and dielectric strength of the internal vacuum. It is essential, therefore, that the interior volume of the interrupter remains hermetically sealed from the external atmosphere to maintain the internal vacuum. The quality of the components and materials must be consistently high to prevent introduction of contaminants into the internal vacuum, and to prevent the external walls of the interrupter from developing weak or porous areas which would threaten the integrity of the internal vacuum.

Suitable component materials have been developed and in general, the interrupter components including the insulating cylindrical envelope, the current conducting terminals, and the endcaps are not prone to degradation which would threaten the integrity of the internal vacuum. Problems may arise, however, in assembly of the components to form a hermetically sealed cylinder. Assembly of the vacuum interrupter components requires at least one brazing seam to hermetically seal the insulating envelope to the endcaps, and another brazing seam to hermetically seal the endcaps to the current carrying terminals.

FIG. 1 illustrates conventional prior art vacuum interrupter 10 comprising cylindrical insulating envelope 12 composed of alumina or the like, endcaps 14 and 16 mounted at opposite ends of insulating envelope 12, with stationary terminal 18 and movable terminal 20 mounted in opposite endcaps. According to prior art practices, annular connector 22 is mounted between the insulating envelope and each endcap and is brazed to the endcaps to hermetically seal the envelope and the endcaps at brazed joint 24. Annular connector 22 generally comprises a material having a coefficient of thermal expansion corresponding to that of the cylindrical insulating envelope.

When the insulating envelope comprises alumina or the like, as shown, metallized end surface 26 is provided at each circumferential edge of the insulating envelope, and the annular connector is additionally brazed to the insulating envelope at brazed joint 28. If the insulating envelope comprises a glass material, one edge of annular connector 22 is typically embedded in the glass envelope, and a brazing seam is required only at the interface between the annular ring and the endcap.

To provide brazed seams having sufficient strength and reliability using conventional brazing techniques, it is important that the materials being brazed have substantially similar coefficients of thermal expansion. The annular connector conventionally used to seal the insulating envelope and the endcaps, as described above, must seal hermetically with materials having different characteristics, namely the insulating envelope and the metallic endcaps. Since the annular connector typically comprises a material having a coefficient of thermal expansion matching that of the insulating envelope, its coefficient of thermal expansion does not match that of the endcap, and consequently, the brazing seam joining the annular connector and the endcap may be prone to fatigue, deterioration and distortion during vacuum operation of the interrupter and/or during the brazing process.

As described above, conventional vacuum interrupters require at least one brazing seam 24 extending a length corresponding to the circumference of the insulating envelope to hermetically seal the envelope to each endcap. When the insulating envelope comprises alumina or the like, conventional vacuum interrupters require two brazing seams 24 and 28, each extending a length corresponding to the circumference of the insulating envelope. The brazing seams represent a critical area of control, since any inconsistency in the brazing technique or deterioration of the brazing materials may leave leakage paths in the brazed seams which permit introduction of contaminants and destroy the integrity of the internal vacuum. One strategy to maintain the integrity of the internal vacuum may thus involve reducing the total length of brazed seams required to assemble and hermetically seal the vacuum interrupter.

The stationary and movable current carrying terminals are mounted through a central portion of endcaps mounted at opposite ends of the insulating envelope. The endcaps must be rigid enough to prevent any diaphramming or bending due to normal contact pressure during reciprocation of the movable contact or electromagnetic forces which are applied during current interruption. Consequently, conventional endcaps comprise a thick section of a rigid, relatively heavy metallic material. The application of forces typically generated during vacuum interruption to an endcap which is not sufficiently rigid results in axial and/or radial movement of the stationary terminal, which destroys or substantially reduces the interrupting capability of the vacuum interrupter.

Accordingly, it is an objective of the present invention to provide a vacuum interrupter having an internal volume which is hermetically sealed from the external atmosphere in a manner which substantially reduces contamination and leakage of the internal vacuum.

It is another objective of the present invention to provide an improved vacuum interrupter which is durable and reliable over the course of longterm operations.

It is still another objective of the present invention to provide a vacuum interrupter having a reduced total length of brazed seams to improve internal vacuum maintenance during longterm operation.

It is yet another objective of the present invention to provide an improved stationary terminal assembly for use in a vacuum interrupter which demonstrates increased structural rigidity.

DISCLOSURE OF THE INVENTION

The vacuum interrupter of the present invention includes an improved stationary terminal assembly having enhanced structural rigidity, which prevents diaphramming or bending of the endcap during operation. Due to the design of the stationery terminal assembly, the vacuum interrupter of the present invention requires a reduced total length of brazed seams, and thus reduces the incidence of vacuum loss due to faulty seams. In addition, the brazed seams required in the vacuum interrupter of the present invention are less prone to deterioration and failure, since the components joined at brazed seams have corresponding coefficients of thermal expansion.

The stationary terminal assembly of the present invention comprises an endcap having a central recess therein for receiving the stationary current carrying terminal and an inwardly directed peripheral flange for sealing with the insulating envelope. The endcap preferably comprises a material having a coefficient of thermal expansion corresponding to the coefficient of thermal expansion of the insulating envelope. When the insulating envelope comprises alumina or the like having a metallized end portion for sealing attachment to the endcap, brazing seams are required at the interface of the endcap with the insulating envelope and at the attachment of the stationary terminal in the endcap. If the insulating envelope comprises a glass material, the peripheral flange of the endcap is embedded in the glass insulating envelope, and a single brazing seam is required at the attachment of the stationary terminal in the endcap.

Since the endcap and the insulating envelope have substantially similar coefficients of thermal expansion, the brazed seam is strong and provides a more reliable hermetic seal. The required total length of brazed seams is significantly reduced compared to conventional vacuum interrupters utilizing an annular connector mounted between the endcap and the insulating envelope. Reducing the total length of brazed seams required for hermetically sealing components of the vacuum interrupter significantly reduces the incidence of fatigue and failure of the brazed seams.

The improved stationary terminal assembly of the present invention additionally comprises a reinforcing member mounted on an interior surface of the endcap to increase the structural rigidity of the endcap and to prevent diaphramming of the endcap when normal contact forces and electromagnetic forces are applied during current interruption. The reinforcing member is preferably annular, and includes a larger diameter portion rigidly mounted on an interior surface of the endcap and a smaller diameter portion rigidly mounted to the current carrying stationary terminal. Since the reinforcing member is located entirely within the internal volume of the vacuum interrupter, the reinforcing member need not be hermetically sealed in place. Utilization of the reinforcing member to provide additional structural rigidity to the endcap and the stationary terminal assembly and permits fabrication of a lighter, thinner endcap from materials which may otherwise be unsuitable.

BRIEF DESCRIPTION OF THE DRAWINGS

The above-mentioned and additional features of the present invention and the manner of obtaining them will become apparent, and the invention will be best understood by reference to the following more detailed description read in conjunction with accompanying drawings, in which.

BEST MODE OF CARRYING OUT THE INVENTION

Figure 1:
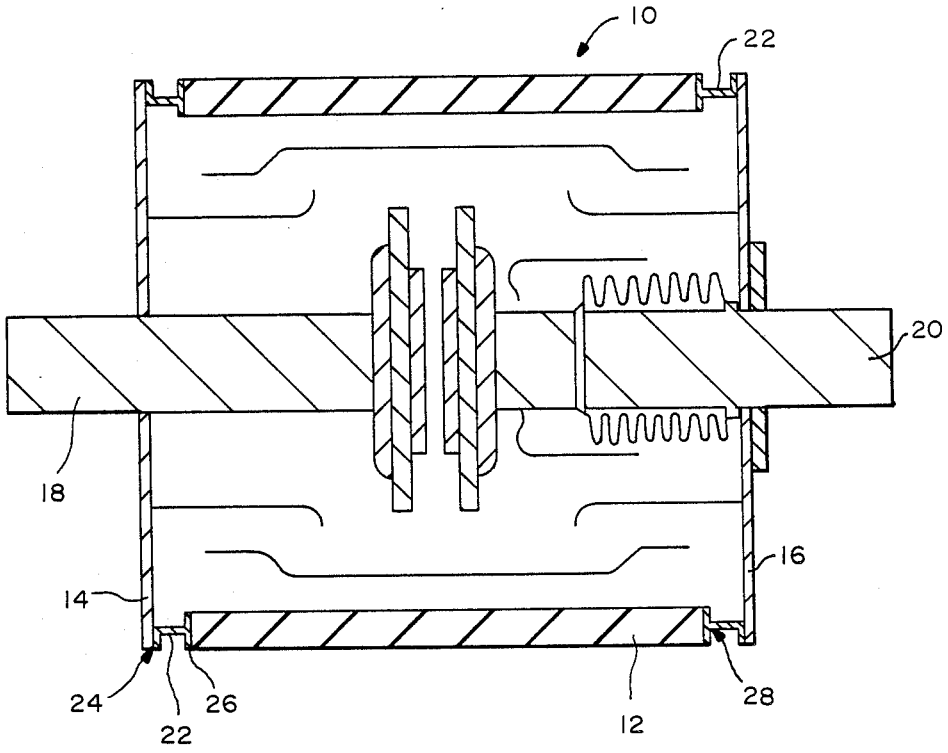
( PRIOR ART ) FIG.— 1
FIG. 1 shows a schematic, partially cross-sectional view of a conventional prior art vacuum interrupter having an alumina insulating envelope.
Figure 2:
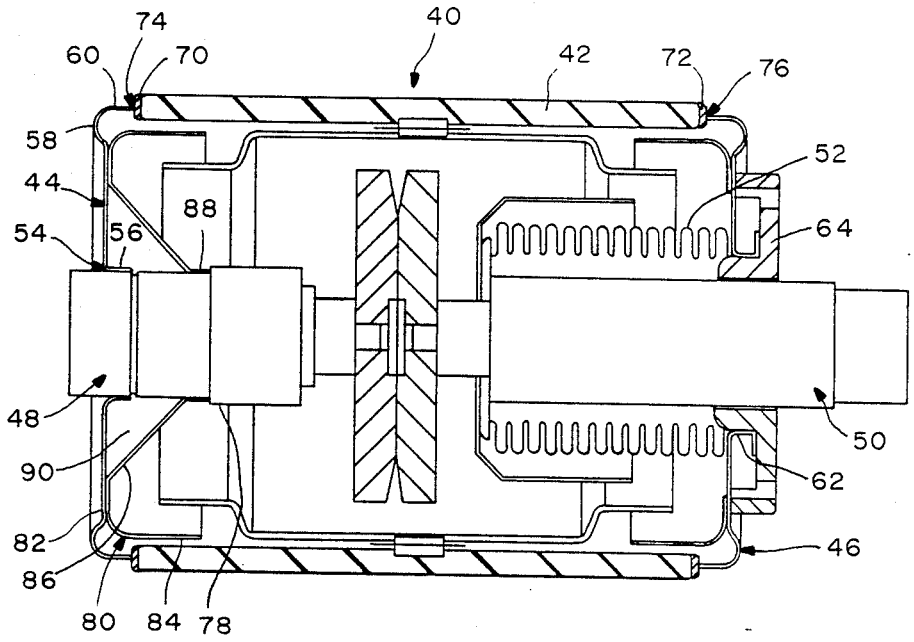
FIG. 2 shows a schematic, partially cross-sectional view of a vacuum interrupter of the present invention, including the improved stationary terminal assembly hermetically sealed with an insulating envelope comprising alumina.

FIG. 2 illustrates vacuum interrupter 40 incorporating an improved stationary terminal assembly according to the present invention. Cylindrical insulating envelope 42 comprises alumina or the like, and insulating envelope 42 is sealed at each circumferential end to endcaps 44 and 46. Stationary terminal 48 having a stationary electrical contact at its internal terminal end is rigidly mounted in endcap 44, while movable terminal 50 having an axially movable electrical contact at its internal terminal end is mounted in endcap 46. Bellows 52 permits axial movement of movable terminal 46 along its central longitudinal axis to make or break contact with the stationary contact.

Endcap 44 comprises a generally circular element having central bore 54 formed by inwardly directed flange 56. Stationary terminal 48 is received through central bore 54, and the stationary terminal is rigidly mounted to endcap 44 by hermetically sealing the stationary terminal to flange 56. Endcap 44 additionally comprises inwardly directed peripheral flange 60 for sealing with a circumferential edge of cylindrical insulating envelope 42. As shown in FIG. 2, endcap 44 is preferably provided with peripheral rim 58 adjacent peripheral flange 60. Endcap 46 has a structure similar to endcap 44, except that movable terminal 50 is sealed to the bellows and to endcap 46, and the movable terminal is mounted through guide 64. Angular central flange 62 is provided in place of inwardly directed flange 56, and angular central flange 62 is adapted to be mounted in guide 64.

It is an important feature of the present invention that endcaps 44 and 46 comprise a material having a coefficient of thermal expansion which is substantially similar to the coefficient of thermal expansion of insulating envelope 42. Suitable materials, such as MONEL, stainless steels, and the like are well known in the art.

Insulating envelope 42, comprising alumina or the like, is provided with metallized circumferential edges 70 and 72 for sealing with endcaps 44 and 46, respectively. Brazed joints 74 and 76 are provided using conventional brazing techniques to hermetically seal endcaps 44 and 46, respectively, to insulating envelope 42. When insulating envelope 42 comprises alumina, as shown in FIG. 2, a single brazed joint extending a length corresponding to the circumference of insulating envelope 42 is required to seal each endcap to the insulating envelope.

Annular reinforcing member 80 is provided in connection with the stationary terminal assembly to increase the structural rigidity of the endcap and the stationary terminal assembly. Annular reinforcing member 80 includes larger diameter annular wall 82 rigidly mounted on an interior surface of endcap 44 by conventional brazing or seam welding techniques, or the like. Larger diameter annular wall 82 is preferably a continuous annular section having a diameter corresponding (approximately to the diameter of endcap 44) adjacent and just interior of peripheral rim 58.

Inwardly directed annular flange 84 is preferably provided along the outer circumferential edge of the annular reinforcing member 80. Continuous tapered wall 86 extends between larger diameter annular wall 82 and smaller diameter flange 88, which is rigidly mounted to the stationary terminal. Continuous tapered wall 86 is preferably provided with one or more apertures for pressure relief and to prevent gases or contaminants from being trapped in recess 90. Stationary terminal 48 preferably includes an enlarged diameter portion 78 located within the internal space of the assembled vacuum interrupter, and smaller diameter flange 88 of the reinforcing member is rigidly mounted to the stationary terminal adjacent enlarged diameter portion 78 by conventional brazing or seam welding techniques, or the like. The stationary terminal assembly of the present invention, including endcap 44, stationary terminal 48 rigidly mounted through a central bore in endcap 44, and reinforcing member 80 rigidly mounted to endcap 44 and stationary terminal 48, provides enhanced structural rigidity.

Figure 3:
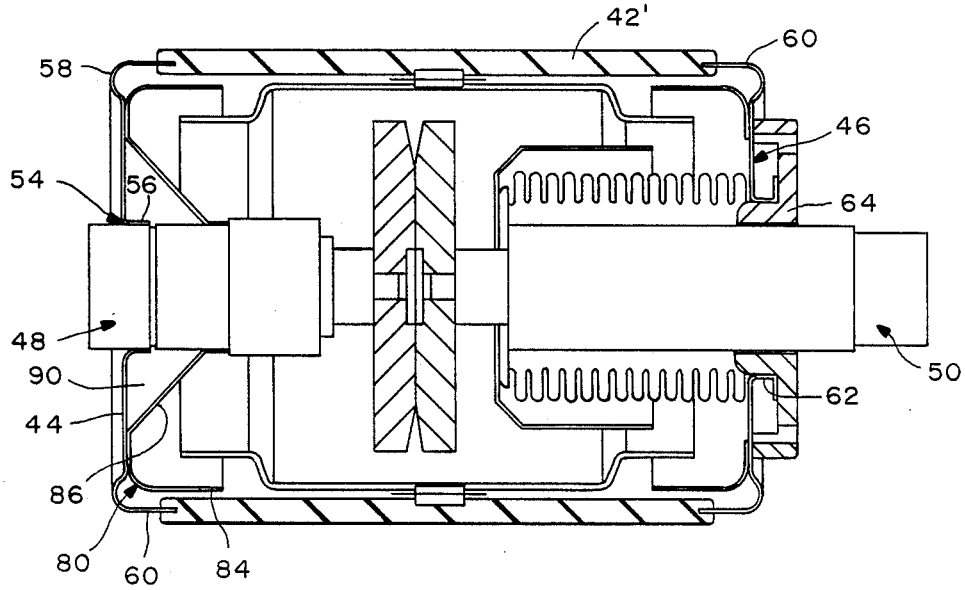
FIG. 3 shows a schematic, partially cross-sectional view of a vacuum interrupter of the present invention, including the improved stationary terminal assembly hermetically sealed with an insulating envelope comprising glass.

FIG. 3 illustrates the stationary terminal assembly of the present invention sealed with cylindrical envelope 42', comprising glass or the like. The stationary terminal assembly is preferably similar and may be identical to that shown in FIG. 2 for use with cylindrical insulating envelope 42 comprising alumina. The terminal edge of peripheral flange 60 is embedded in the circumferential edge of cylindrical insulating envelope 42 to provide a hermetic seal, by techniques which are well known in the art. Similarly, the peripheral flange of endcap 46 is embedded in the other circumferential edge of cylindrical envelope 42' to provide a hermetically sealed vacuum interrupter.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A vacuum interrupter comprising:

a cylindrical insulating envelope formed of a material having a given coefficient of thermal expansion;

an endcap integrally formed as a single unit of material having a coefficient of thermal expansion substantially similar to said given coefficient mounted at each circumferential edge of said cylindrical envelope, each of said endcaps having an inwardly directed flange extending the length of its circumferential edge, said inwardly directed flanges hermetically sealed directly with said circumferential edges of said cylindrical envelope;

a stationary terminal rigidly mounted in a central portion of one endcap; and a movable terminal mounted for axial movement along its central longitudinal axis in a central portion of an opposite endcap.

2. A vacuum interrupter according to claim 1, wherein said cylindrical insulating envelope comprises glass, and said inwardly directed flanges of said endcaps are embedded in said circumferential edges of said cylindrical insulating envelope to provide hermetic seals.

3. A vacuum interrupter according to claim 1, wherein said cylindrical insulating envelope comprises alumina and said circumferential edges of said insulating envelope have metallized surfaces, and a brazed joint hermetically seals said metallized surfaces to said inwardly directed flanges of said endcaps.

4. A vacuum interrupter according to claim 1, additionally comprising a reinforcing member mounted on an internal surface of said endcap.

5. A vacuum interrupter according to claim 4, wherein said reinforcing member has a tapered intermediate wall joining said larger diameter portion and said smaller diameter portion.

6. A vacuum interrupter according to claim 5, wherein said tapered intermediate wall of said reinforcing member is provided with at least one aperture.

7. A vacuum interrupter according to claim 5, wherein said stationary terminal has an enlarged diameter portion, and said smaller diameter portion of said reinforcing member is rigidly mounted on said stationary terminal adjacent said enlarged diameter portion.

8. A stationary terminal assembly for use in a vacuum interrupter, comprising:

a cylindrical insulating envelope formed of a material having a given coefficient of thermal expansion;

an endcap integrally formed as a single unit of material having a coefficient of thermal expansion substantially similar to said given coefficient having a central recess therein for receiving a stationary terminal and an inwardly directed peripheral flange for sealing directly with said cylindrical insulating envelope; and a stationary terminal rigidly mounted in said central recess of said endcap.

9. A stationary terminal assembly according to claim 8, wherein said endcap comprises a material having a coefficient of thermal expansion substantially similar to that of said cylindrical insulating envelope.

10. A stationary terminal assembly according to claim 8, additionally comprising a reinforcing member mounted on an internal surface of said endcap.

11. A stationary terminal assembly according to claim 5, wherein said reinforcing member has a tapered intermediate wall joining said larger diameter portion and said smaller diameter portion.

12. A stationary terminal assembly according to claim 11, wherein said tapered intermediate wall of said reinforcing member is provided with at least one aperture.

13. A stationary terminal assembly according to claim 11, wherein said stationary terminal has an enlarged diameter portion, and said smaller diameter portion of said reinforcing member is rigidly mounted on said stationary terminal adjacent said enlarged diameter portion.

14. A vacuum interrupter comprising:

a cylindrical insulating envelope formed of a material having a given coefficient of thermal expansion;

an endcap integrally formed as a single unit of material having a coefficient of thermal expansion substantially similar to said given coefficient mounted at each circumferential edge of said cylindrical envelope, each of said endcaps having an inwardly directed flange extending the length of its circumferential edge, said inwardly directed flanges hermetically sealed directly with said circumferential edges of said cylindrical envelope.

a stationary terminal rigidly mounted in a central portion of one endcap;

a movable terminal mounted for axial movement along its central longitudinal axis in a central portion of an opposite endcap; and a reinforcing member mounted on an internal surface of said endcap, said reinforcing member being annular and having a larger diameter portion rigidly mounted on said internal surface of said endcap and a smaller diameter portion rigidly mounted on said stationary terminal.

15. A stationary terminal assembly for use in a vacuum interrupter, comprising:

a cylindrical insulating envelope formed of a material having a given coefficient of thermal expansion;

an endcap integrally formed as a single unit of material having a coefficient of thermal expansion substantially similar to said given coefficient having a central recess therein for receiving a stationary terminal and an inwardly directed peripheral flange for sealing directly with said cylindrical insulating envelope; and a stationary terminal rigidly mounted in said central recess of said endcap; and a reinforcing member mounted on an internal surface of said endcap, said reinforcing member being annular and having a larger diameter portion rigidly mounted on said internal surface of said endcap and a smaller diameter portion rigidly mounted on said stationary terminal.

* * * * *